US005487693A

United States Patent [19]

Prusaitis et al.

[11] Patent Number: 5,487,693

[45] Date of Patent: Jan. 30, 1996

[54] SHARPENING DEVICE AND METHOD FOR SHARPENING A DENTAL INSTRUMENT

[76] Inventors: John H. Prusaitis; Timothy J. Prusaitis, both of c/o 5706 Northwest Hwy., Chicago, Ill. 60646

[21] Appl. No.: 299,250

[22] Filed: Aug. 31, 1994

Related U.S. Application Data

[63] Continuation of Ser. No. 6,137, Jan. 19, 1993, abandoned, which is a continuation of Ser. No. 826,139, Jan. 27, 1992, abandoned.

[51] Int. Cl.[6] ..... B24D 15/06

[52] U.S. Cl. ..... 451/45; 451/540; 451/552; 451/557

[58] Field of Search ..... 51/204, 205 R, 51/211 R, 285; 451/540, 557, 552, 45, 556

[56] References Cited

U.S. PATENT DOCUMENTS

| | | | |
|---|---|---|---|
| 945,771 | 1/1910 | Ensminger | 51/285 |
| 1,750,504 | 3/1930 | Brongher | 51/173 |
| 2,120,483 | 6/1938 | Burger | 51/205 R |
| 2,442,088 | 4/1947 | Kreutzer | 51/205 R |
| 2,453,207 | 11/1948 | Dunn | 51/211 R |
| 3,097,457 | 7/1963 | Seligman | 51/205 R |
| 3,722,146 | 3/1973 | Rodriguez | 51/73 R |
| 3,755,970 | 9/1973 | Parr | 51/204 |
| 4,509,268 | 4/1985 | Marquam | 51/59 R |
| 4,821,462 | 4/1989 | Moore | 51/214 |
| 5,103,599 | 4/1992 | Carlson | 51/382 |
| 5,155,939 | 10/1992 | Pheulpin | 51/57 |
| 5,197,227 | 3/1993 | Svanberg | 51/125 |

FOREIGN PATENT DOCUMENTS

| | | | |
|---|---|---|---|
| 8602872 | 11/1985 | Germany | 51/205 R |
| 605743 | 7/1948 | United Kingdom | 51/205 |

*Primary Examiner*—Bruce M. Kisliuk
*Assistant Examiner*—Eileen P. Morgan
*Attorney, Agent, or Firm*—Marshall, O'Toole, Gerstein, Murray & Borun

[57] ABSTRACT

In order to achieve precision in sharpening, particularly for dental instruments, a sharpening device includes a base having a generally upwardly extending hand grip portion wherein the base is adapted to be position on a generally horizontal supporting surface. The sharpening device also includes a sharpening stone or the like operatively associated with the base together with a retainer for removably retaining the sharpening stone in at least one angular position relative to the generally horizontal supporting surface. Further, a method of sharpening a dental instrument having a cutting edge defined by a face and lateral side is disclosed. The sharpening method includes providing a support for a sharpening stone at a preselected angle to a horizontal plane and then holding the dental instrument with one hand while also holding the support with the other hand. With this accomplished, the method further includes placing the lateral side of the dental instrument into direct contact with the sharpening stone, orienting the dental instrument with the face parallel to the horizontal plane, and thereafter imparting relative movement therebetween.

5 Claims, 2 Drawing Sheets

SHARPENING DEVICE AND METHOD FOR SHARPENING A DENTAL INSTRUMENT

This is a continuation of application Ser. No. 08/006,137, filed Jan. 19, 1993, now abandoned which is a continuation of prior application Ser. No. 07/826,139, filed on Jan. 27, 1992, now abandoned.

FIELD OF THE INVENTION

The present invention is generally directed to sharpening techniques and, more particularly, a sharpening device and method suited for dental instruments and the like.

BACKGROUND OF THE INVENTION

Generally speaking, there has been a variety of sharpening techniques that have been utilized over the years. It is known, for instance, that devices having a cutting edge, such as a knife or instrument, can be sharpened by utilizing a flat abrasive surface such as that found on a sharpening stone. Unfortunately, a significant percentage of people are unable to sharpen a knife or instrument in an effective manner.

For instance, in the case of dental instruments, experience demonstrates that approximately 80 to 90 percent are sharpened incorrectly. This occurs primarily due to the fact that there is typically a failure to maintain the proper angle between the face of the instrument and the lateral side thereof, i.e., an angle of between approximately 70 and 80 degrees during the sharpening process. As a result, the angle defined by the cutting edge of a dental instrument is often improper, i.e., either too sharp or too dull.

Based upon an investigation into this problem, it has been determined that sharpening an instrument requires a talent known as abstract reasoning. This talent, which is unrelated to intelligence, involves the ability to visualize three dimensional objects in the mind and manipulate such objects without losing perspective. From aptitude tests that evaluate the ability of individuals in abstract reasoning, it has been determined that only approximately 10 percent of the population has this talent.

From the foregoing, it will be apparent that there is a problem of serious proportions in connection with the sharpening of dental instruments. It is well known that a cutting edge of less than 70° is quite sharp, but also very thin, meaning that it wears down quickly and becomes dull and, on the other hand, a cutting edge of more than 80° requires heavy lateral pressure to remove deposits meaning that calculus removal is often incomplete with such an instrument and root planing cannot be done effectively. For these reasons, it is well recognized that there has been a continuing need for improved sharpening techniques for dental instruments.

The present invention is directed to overcoming one or more of the foregoing problems and achieving one or more of the resulting objects.

SUMMARY OF THE INVENTION

Accordingly, it is a principal object of the present invention to provide a sharpening device and method insuring a proper cutting edge. It is a further object of the present invention to provide such a device and method for sharpening a dental instrument having a cutting edge defined by a face and lateral side. Additionally, it is an object of the present invention to provide a sharpening device and method requiring little, if any, ability in abstract reasoning.

To this end, the present invention is generally directed to a sharpening device having a base including a generally upwardly extending hand grip portion wherein the base is adapted to be positioned on a generally horizontal supporting surface. The sharpening device also includes sharpening means operatively associated with the base in at least one angular position relative to the generally horizontal supporting surface and retention means for removably retaining the sharpening means in that position. Preferably, the sharpening means includes a sharpening stone and the retention means includes an upper stone rest and a lower stone rest, with the retention means further including a spring biased retainer lid operatively associated with an upper extreme of the hand grip portion.

In an exemplary embodiment of the present invention, the sharpening device is suited for dental instruments and the base has a generally planar support surface adapted to be positioned on the generally horizontal supporting surface. The hand grip portion is advantageously integral with and extends generally upwardly from the generally planar support surface. Still additionally, the sharpening device preferably includes at least a pair of lower stone rests integral with an angularly inclined surface portion of the generally planar support surface of the base wherein the lower stone rests are positioned so as to support the stone in either of two distinct angular positions. The upper stone rest is advantageously integral with the hand grip portion in upwardly spaced relation to the generally planar support surface. With this arrangement, the sharpening stone can be placed against the upper stone rest and either of the lower stone rests to position the sharpening stone within an angular range of between approximately 100° and 110°.

In another respect, the present invention is directed to a method of sharpening a dental instrument having a cutting edge which is defined by a face and a lateral side. The method includes the steps of providing means for supporting a sharpening stone at a preselected angle to a horizontal plane, holding the dental instrument with one hand while holding the supporting means with the other hand, placing the lateral side of the dental instrument into direct contact with the sharpening stone, and orienting the dental instrument such that the face is disposed parallel to the horizontal plane. Thereafter, relative movement is imparted between the dental instrument and the sharpening stone to sharpen the dental instrument.

Preferably, this is done by holding the supporting means stationery and moving the dental instrument with the face maintained parallel to the horizontal plane.

Other objects, advantages and features of the present invention will become apparent from a consideration of the following specification taken in conjunction with the accompanying drawings.

DETAILED DESCRIPTION OF THE PREFERRED EMBODIMENT

Figure 1:
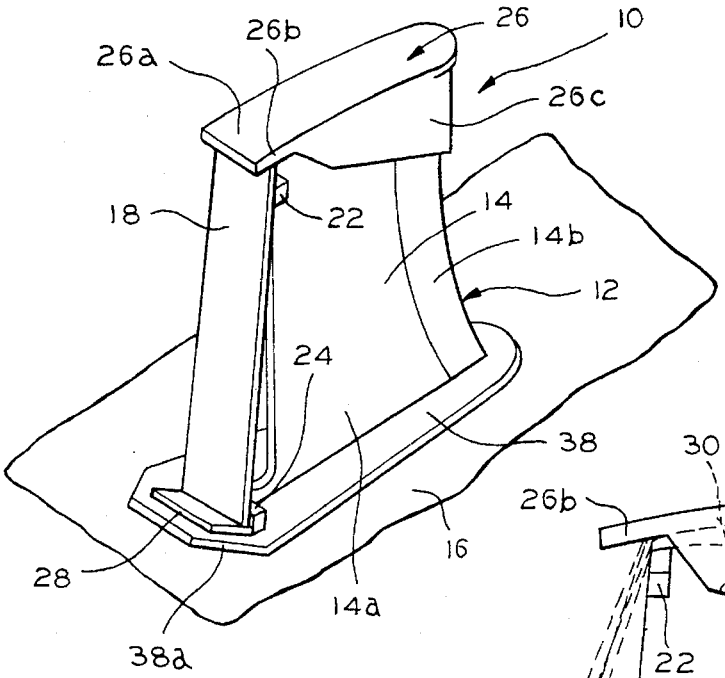
FIG. 1 is a perspective view of a sharpening device in accordance with the present invention.

In the illustrations given, and with reference first to FIG. 1, the reference numeral 10 designates generally a sharpening device in accordance with the present invention. The sharpening device 10 includes a base 12 having a generally upwardly extending hand grip portion 14 wherein the base 10 is adapted to be positioned on a generally horizontal supporting surface 16. Sharpening means, such as a sharpening stone 18, is operatively associated with the base 12 in at least one angular position relative to the generally horizontal supporting surface 16. The sharpening device 10 also includes retention means for removably retaining the sharpening stone 18 in at least one angular position relative to the generally horizontal supporting surface 16. In the illustrated embodiment, the retention means includes an upper stone rest 22, a lower stone rest 24, and a spring biased retainer lid 26.

As will be appreciated, the lower stone rest 24 is integral with the base 12 at a point generally adjacent to the generally horizontal supporting surface 16. In a highly preferred embodiment, the sharpening device 10 includes at least a pair of lower stone rests such as 24 and 28 positioned so as to support the sharpening stone 18 in either of two distinct angular positions (see FIG. 2) relative to the generally horizontal supporting surface 16, and the upper stone rest 22 is operatively associated with an upper extreme of the hand grip portion 14. In other words, the upper stone rest 22 is integral with the hand grip portion 14 at a point spaced well above the generally horizontal supporting surface 16.

Figure 2:
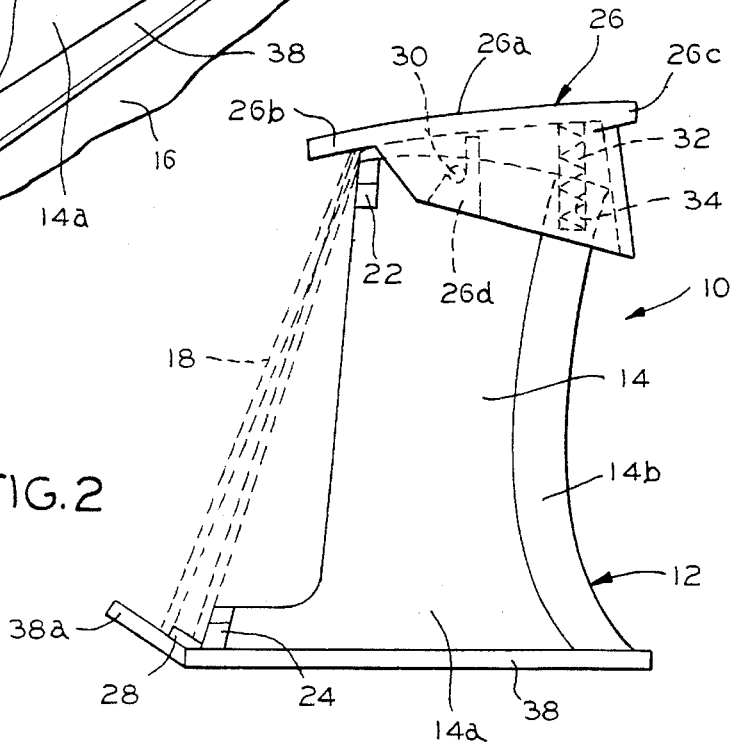
FIG. 2 is a full side elevational view showing detailed features of the sharpening device as illustrated in FIG. 1.

As will be appreciated by referring to FIG. 2, the retainer lid 26 is pivotally mounted to the hand grip portion 14 at the upper extreme for normal engagement with the sharpening stone 18. It will be appreciated that the retainer lid 26 has a generally planar upper surface **26*a* including a forward retainer edge 26*b* for normal engagement with the sharpening stone 18. The retainer lid 26 also will be seen to have a generally U-shaped skirt portion 26*c* depending from the generally planar upper surface 26*a*. It will further be appreciated that a pair of retainer hooks such as 26*d* are integral with and supported by the skirt portion 26*c*. Still referring to FIG. 2, the retainer hooks such as 26*d* pivotally engage a corresponding pair of posts such as 30 on the hand grip portion 14 of the base 12**.

As will be appreciated, the retainer hooks such as **26*d* are intermediate the forward retainer edge 26*b* and a rear edge 26*e* of the retainer lid 26. It will also be seen that the retainer hooks are integral with the inner surface of the skirt portion 26*c* where they are normally hidden from view, and a spring 32 is disposed between the hand grip portion 14 of the base 12 and the underside of the generally planar upper surface 26*a* of the retainer lid 26 adjacent the rear edge 26*e* thereof. Further, the hand grip portion 14 of the base 12 preferably has a hole 34 in which a portion of the spring 32 is disposed substantially as shown in FIG. 2**.

Figure 3:
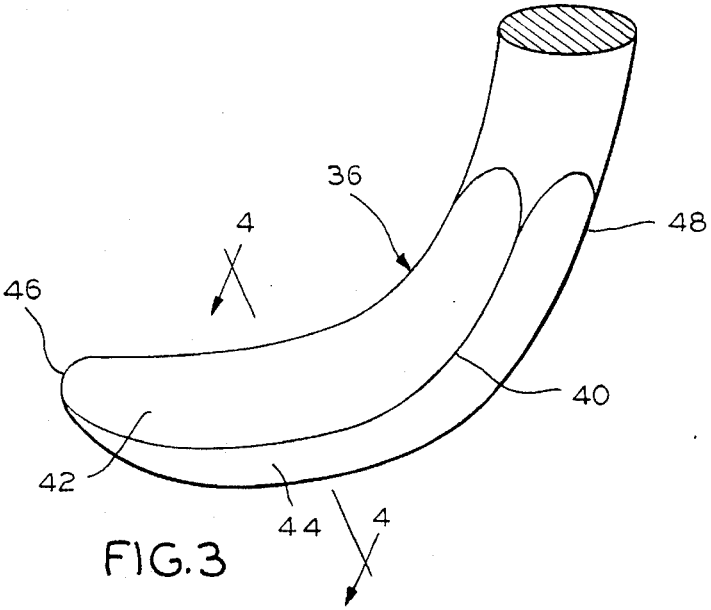
FIG. 3 is a partial perspective view of one type of dental instrument for use with the sharpening device of FIG. 1.
Figure 4:
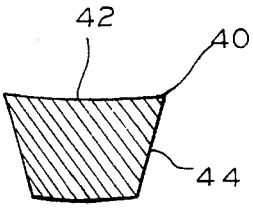
FIG. 4 is a cross-sectional view of the dental instrument taken along the line 4—4 of FIG. 3.

While the sharpening device 10 is well suited for many applications, it is particularly advantageous for sharpening a dental instrument 36 (see FIG. 3). In a most highly preferred embodiment, the sharpening device 10 is formed such that the base 12 includes a generally planar support surface 38 adapted to be positioned on the generally horizontal supporting surface 16 wherein the hand grip portion 14 is integral with and extends generally upwardly from the generally planar support surface 38 as shown in FIG. 1. As a result, the generally planar support surface 38 will be understood to be in an immediately adjacent parallel plane to the generally horizontal supporting surface 16.

Referring to FIGS. 1 and 2, the lower stone rests 24 and 28 are integral with an angularly inclined surface portion **38*a* of the generally planar support surface 38 and the upper stone rest 22 is integral with the hand grip portion 14 in upwardly spaced relation to the generally planar support surface 38. As previously suggested, the lower stone rests 24 and 28 are positioned in relation to one another and the upper stone rest 22 so as to support the sharpening stone 18 in either of two distinct angular positions relative to the generally planar support surface 38** within an angular range of between approximately 100° and 110°.

Advantageously, the lower stone rest 24 will support the sharpening stone 18 at an angle of 100° while the lower stone rest 28 will support the sharpening stone 18 at an angle of 110° whereby the sharpening device is suited for sharpening a curet in the former case and a scaler in the latter case, respectively.

As will be appreciated from FIGS. 1 and 2, the hand grip portion 14 of the base 12 is generally planar as at **14*a* and is also generally perpendicular to the generally planar support surface 38. It will still further be appreciated that, in the preferred embodiment, the sharpening stone 18 is a generally planar rectangle. With this arrangement, the hand grip portion 14 of the base 12 has an enlarged, contoured and curved hand grip 14*b* on a generally upwardly extending edge positioned directly opposite the sharpening stone 18**.

Figure 5:
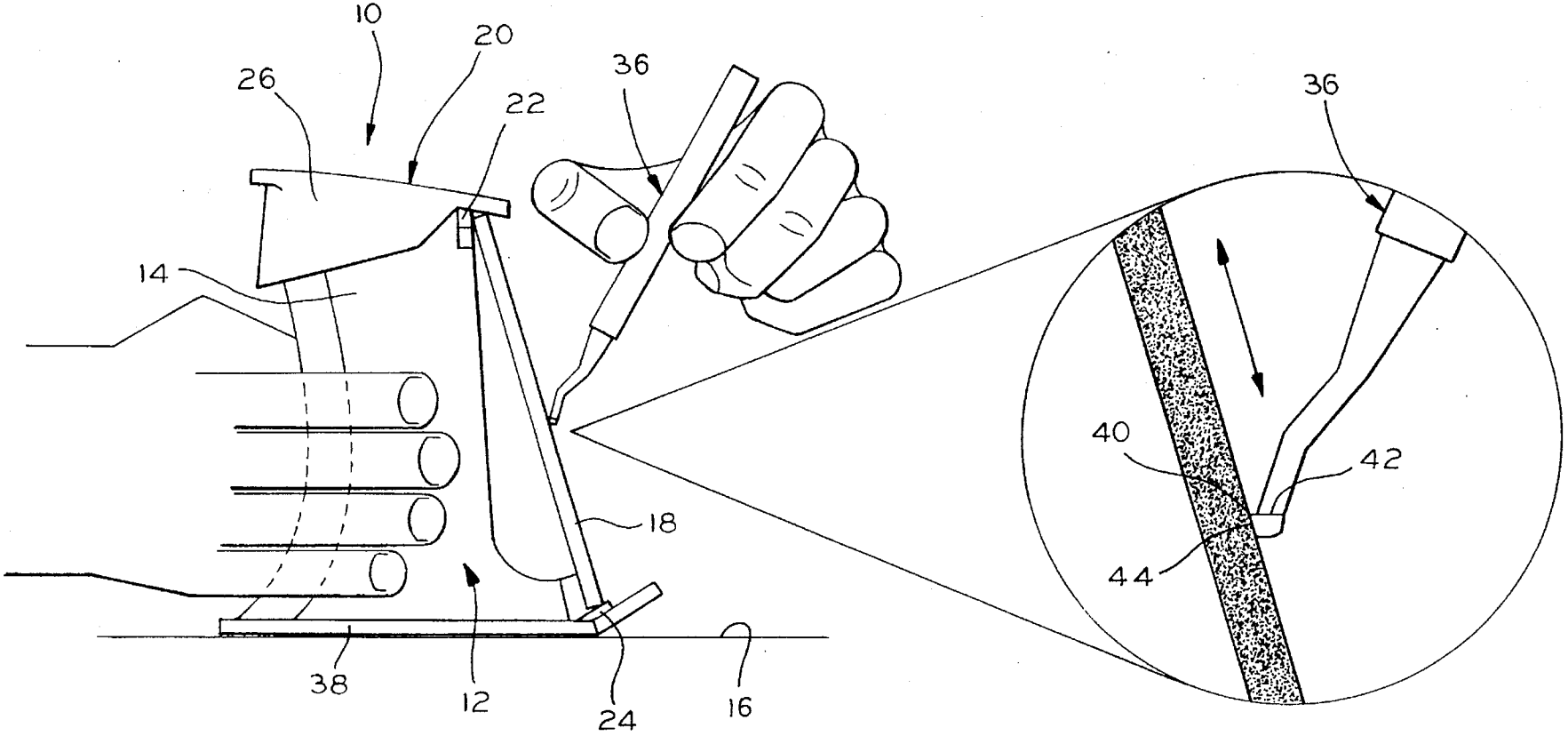
FIG. 5 is a side elevational view with an enlarged detail balloon showing use of the sharpening device of FIG. 1.

In another respect, and as illustrated in FIG. 5 the present invention will be understood as being directed to a method of sharpening a dental instrument such as 36 having a cutting edge 40 defined by a face 42 and a lateral side 44. The method includes the steps of providing means for supporting a sharpening stone 18 at a preselected angle to a horizontal plane and holding the dental instrument such as 36 with one hand while holding the supporting means with the other hand, placing the lateral side 44 of the dental instrument such as 36 into direct contact with the sharpening stone 18 and orienting the dental instrument such as 36 such that the face 42 is disposed parallel to the horizontal plane. With this accomplished, the present invention achieves the objective of sharpening a dental instrument such as 36 by imparting relative movement between the dental instrument such as 36 and the sharpening stone 18.

As previously suggested, the preselected angle or angles at which the sharpening stone 18 is supported is within an angular range of between approximately 100° and 110°. It is possible in this connection for the supporting means, such as the sharpening device 10, to be held stationery while the dental instrument is moved in an up and down motion relative to the sharpening stone 18 or, alternatively, the dental instrument such as 36 may be moved in a circular motion relative to the sharpening stone but, in either case, the dental instrument such as 36 is preferably moved with the face 42 maintained parallel to the horizontal plane. In any event, the sharpening method advantageously includes the step of moving the dental instrument such as 36 so as to follow contours of the lateral side 44 thereof from the toe 46 to the heel 48.

As will be appreciated, the dental instrument which has been illustrated for purposes of understanding one of the important applications of the present invention is a curet 36. It is advantageous to sharpen the curet 36 by first positioning the sharpening stone 18 so as to be in contact with the lower rest 28 and the upper rest 32. This is accomplished by depressing the retainer lid 26 so as to overcome the biasing force of the spring 34 in such manner as to temporarily disengage the front edge **26*b* from engagement with the sharpening stone 18. It is then possible for the retainer lid 26 to be released to once again secure the sharpening stone 18 in the desired position. With this accomplished, the curet 36 may be held in the manner of a spoon containing a liquid wherein the face 42** is parallel to a horizontal plane.

As will be appreciated, the action required to sharpen a dental instrument according to the present invention is within the personal experience of nearly everyone. In other words, it is a common experience for anyone who has taken liquid medicine to hold a spoon such that the liquid does not spill and by holding the curet 36 in precisely the same manner with the face 42 in the same horizontal plane of the liquid in a spoon the curet 36 with be in the correct position for sharpening the lateral side 44 so as to form a cutting edge with the face 42 of 70°. As a result, the requirement to possess the talent of abstract reasoning is eliminated, and sharpening becomes almost universally achievable by utilizing the invention herein.

In other words, the angle necessary for proper sharpening has been placed into a perspective where it is easily visualized even without the ability of abstract reasoning.

In use, the dental instrument such as 36 is held in the dominant hand and the hand grip **14*b* is held with the other hand. The dental instrument such as 36 (or the sharpening device 10) is then turned during sharpening to follow the contours of the lateral side 44 so as to ensure retaining the original shape of the face 42 while sharpening. After every few strokes, the cutting edge 40** is tested against a plastic test rod.

More specifically, the cutting edge 40 is utilized to scale the rod as if it were a tooth. This action is known to provide a good indication of the sharpness of the cutting edge 40. Also, by scaling the rod, any burr or wire edge that may have formed during sharpening will be removed.

With the present invention, the sharpening process is simplified so that a far greater percentage of people can sharpen effectively. Also, the sharpening device permits easy sharpening stone replacement as well as substitution of a wide variety of abrasives in an apparatus that is easy to assemble and disassemble. Further, the angularly inclined portion **38*a* of the generally planar support surface 38 and the front edge 26*b* of the retainer lid 26 serve to reduce the risk of personal injury. Specifically, these elements form stops with the only hand that could be cut being positioned considerably distant from the sharpening stone 18 by reason of the location of the hand grip portion 14*b***. Still further, the sharpening device can be used chair side in a dental office by forming it of stainless steel so as to be fully sterilizable.

While in the foregoing there has been set forth a preferred embodiment of the invention, it will be appreciated that the details herein given may be varied by those skilled in the art without departing from the true spirit and scope of the appended claims.

We claim:

1. A method of sharpening a dental instrument having a handle and a tip formed to have a cutting edge defined by a face and lateral side, comprising the steps of:

providing base means supporting a sharpening stone in a fixed position and placing said base means on a horizontal surface to cause said sharpening stone to be fixed at a preselected angle to said horizontal surface;

holding said handle of said dental instrument with one hand and holding said base means with the other hand;

placing said lateral side of said tip of said dental instrument into direct contact with said sharpening stone;

orienting said tip of said dental instrument such that said face is disposed parallel to said horizontal surface and in a horizontal plane without regard to the angle of said handle relative to said sharpening stone; and thereafter imparting relative movement between said tip of said dental instrument and said sharpening stone while maintaining said face parallel to said horizontal surface and in a horizontal plane without regard to the angle of said handle relative to said sharpening stone.

2. The sharpening method of claim 1 wherein said preselected angle is within an angular range of between approximately one hundred and one hundred ten degrees to said horizontal plane.

3. The sharpening method of claim 1 wherein said supporting means is held stationary and said dental instrument is moved in an up and down motion relative to said sharpening stone.

4. The sharpening method of claim 1 wherein said supporting means is held stationary and said dental instrument is moved in a circular motion relative to said sharpening stone.

5. The sharpening method of claim 1 wherein said supporting means is held stationary and said dental instrument is moved so as to follow contours of said lateral side thereof.

* * * * *